US005453055A

United States Patent [19]

van Huystee

[11] Patent Number: 5,453,055

[45] Date of Patent: Sep. 26, 1995

[54] ADJUSTABLE HEIGHT SLIDE

[75] Inventor: Maarten van Huystee, East Aurora, N.Y.

[73] Assignee: Fisher-Price, Inc., East Aurora, N.Y.

[21] Appl. No.: 293,158

[22] Filed: Aug. 19, 1994

[51] Int. Cl.[6] ..... A63G 21/18

[52] U.S. Cl. ..... 472/116; 482/23; D21/244

[58] Field of Search ..... 472/116, 117, 472/137; 482/23, 51; 446/487, 489; D21/241–244

[56] References Cited

U.S. PATENT DOCUMENTS

| | | | |
|---|---|---|---|
| D. 244,704 | 6/1977 | Smyrni et al. | D34/5 M |
| D. 294,378 | 2/1988 | Spirk et al. | D21/244 |
| D. 303,826 | 10/1989 | Aker | D21/244 |
| D, 330,743 | 11/1992 | Mercer | D21/244 |
| D. 334,610 | 4/1993 | Aker | D21/244 |
| D. 343,438 | 1/1994 | Fish, Jr. | D21/244 |
| D. 344,773 | 3/1994 | Aker et al. | D21/244 |
| 4,369,965 | 1/1983 | Ahrens | 272/56.5 |
| 4,943,048 | 7/1990 | Hentges | 472/116 |
| 5,372,550 | 12/1994 | Gleeson et al. | 472/116 |

OTHER PUBLICATIONS

Step Two: A Step Beyond, 1994, "First Climber", p. 4.
Step Two: A Step Beyond, 1994, "Combo Climber", p. 5.
Step Two: A Step Beyond, 1994, "Slide Center", p. 25.
Step Two: A Step Beyond, 1994, "Mushroom Climber", p. 28.
Step Two: A Step Beyond, 1994, "Big Climber", p. 29.
Today's Kids Wish Book, 1994, "Play'N Fold Clubhouse", p. 3.
Today's Kids: Better Toys, by Design, 1994, "Play Slide", p. 19.
Little Tikes: Toys That Last, 1994, "Evergreen Big Slide", p. 56.
Little Tikes: Toys That Last, 1994, "Big Slide", p. 58.
Little Tikes: Toys That Last, 1994, "Play Slide", p. 58.
Little Tikes: Toys That Last, 1994, "Tike Treehouse", p. 58.
Flexible Flyer Company: "Playslide", p. 3.

*Primary Examiner*—Carl O. Friedman
*Assistant Examiner*—Beth A. Aubrey
*Attorney, Agent, or Firm*—Howrey & Simon; C. Scott Talbot; Leo J. Jennings

[57] ABSTRACT

An adjustable-height free standing slide apparatus has an overall slide surface length that can be increased or decreased by changing the orientation of a single component. The slide apparatus includes a frame that supports a slide member. The frame also supports a block member that can be mounted to the frame in a first orientation in which a first surface on the block forms a substantially horizontal platform surface leading to the top of the slide and a second orientation in which a second surface on the block forms a slide exterior surface meeting substantially contiguously with the slide surface to extend the overall slide surface length.

6 Claims, 23 Drawing Sheets

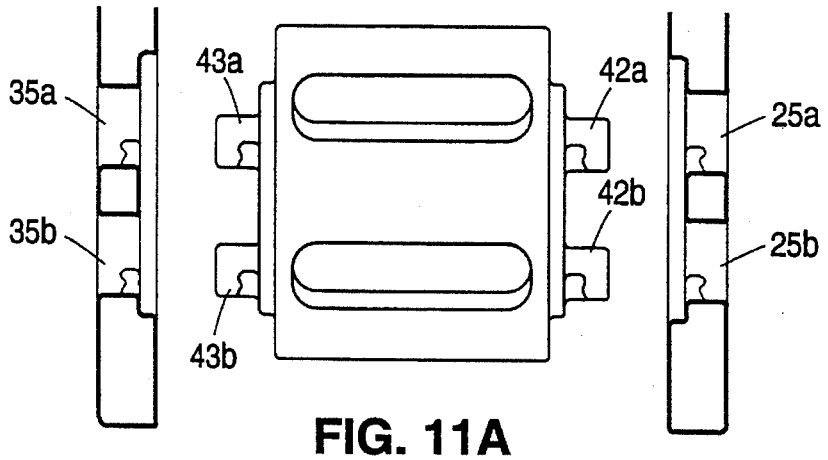
FIG. 11A
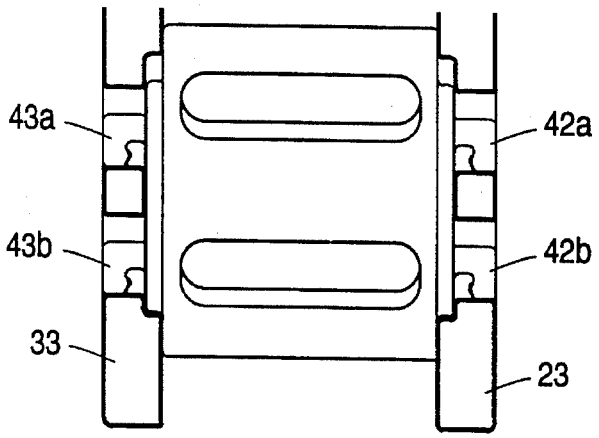
FIG. 11B
FIG. 11C
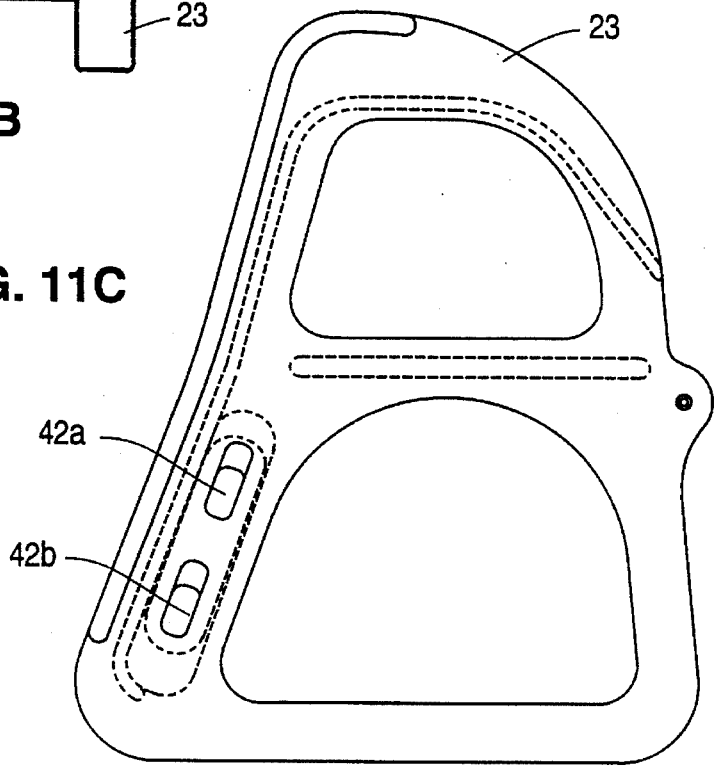

ADJUSTABLE HEIGHT SLIDE

BACKGROUND OF THE INVENTION

This invention relates to a freestanding children's slide apparatus that has an adjustable slide height. More specifically, the invention relates to a slide where the overall slide length and height may be adjusted conveniently by changing the orientation of a component of the slide apparatus.

Freestanding outdoor slides for children are known. One example of a known slide includes a rigid ladder piece or assembly connected at the top of the ladder to a single, rigid, slide piece. A cross member at each side connects a medial portion of the ladder to a medial portion of the slide member, providing a generally A-shaped configuration when viewed from the side.

This type of slide suffers from the disadvantage that the overall height of the slide is not adjustable. A small slide which is suitable for smaller and younger children may not be suitable for use by older and larger children. Thus, it may be necessary for the user to purchase two slides in order to have slides of different heights. Accordingly, there exists a need in the prior art for a slide that has a conveniently adjustable slide height.

SUMMARY OF THE INVENTION

The drawbacks of the prior art are overcome by the apparatus of the invention which provides a slide where the slide height and the overall slide length may be adjusted conveniently by changing the orientation of a component of the slide apparatus.

The invention provides an adjustable-height freestanding slide apparatus that has an overall slide surface length that can be increased or decreased by changing the orientation of a slide-block component. The slide apparatus includes a frame that supports a slide member, and the frame also supports a block member that can be mounted to the frame in a first orientation in which a first surface on the block forms a substantially horizontal platform surface leading to the top of the slide and a second orientation in which a second surface on the block forms a slide extension surface meeting substantially contiguously with the slide surface to extend the overall slide surface length.

BRIEF DESCRIPTION OF THE DRAWINGS

FIG. 11A is an exploded view slowing the connectors for the ladder member and the side support members.

FIGS. 11B and 11C are layout views showing assembled connectors for the ladder member and the side support members.

DETAILED DESCRIPTION

Figure 1A:
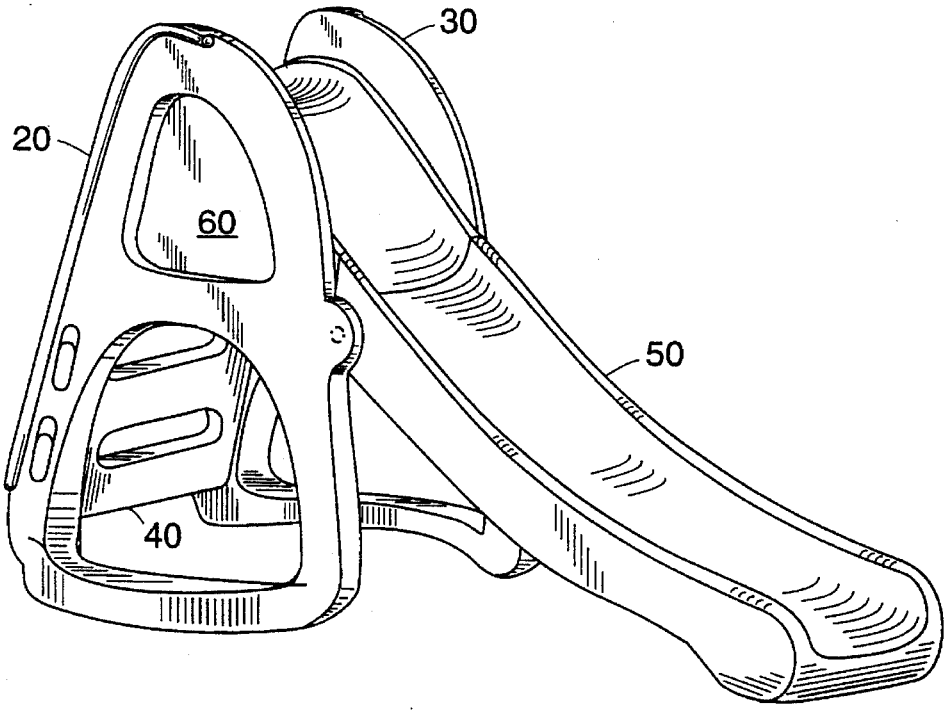
FIG. 1A is a perspective view of the slide apparatus in the high slide height configuration.
Figure 1B:
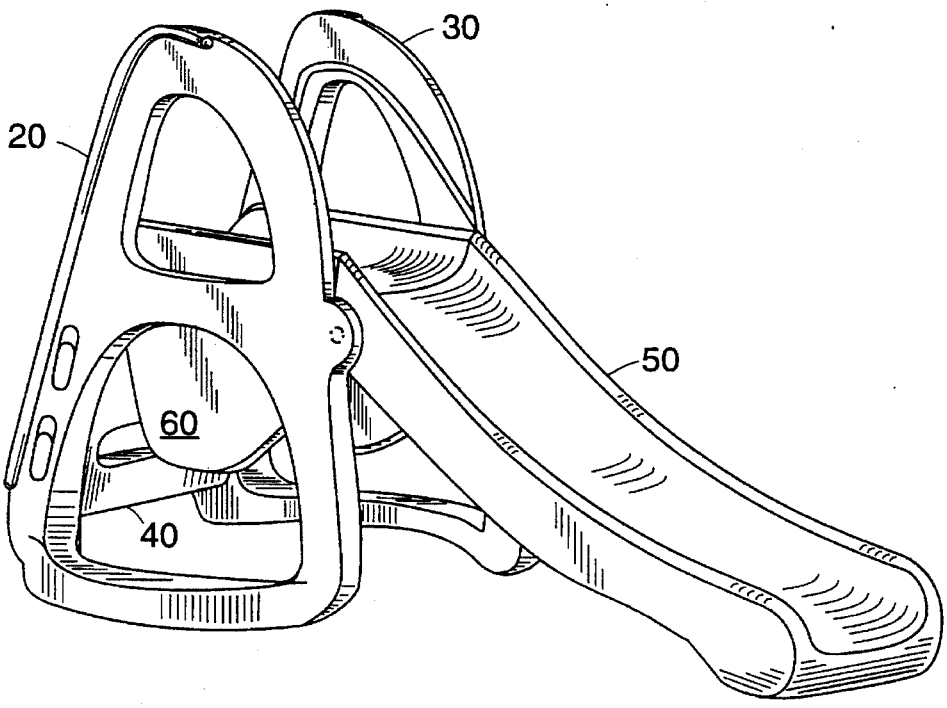
FIG. 1B is a perspective view of the slide apparatus in the low slide height configuration.
Figure 1C:
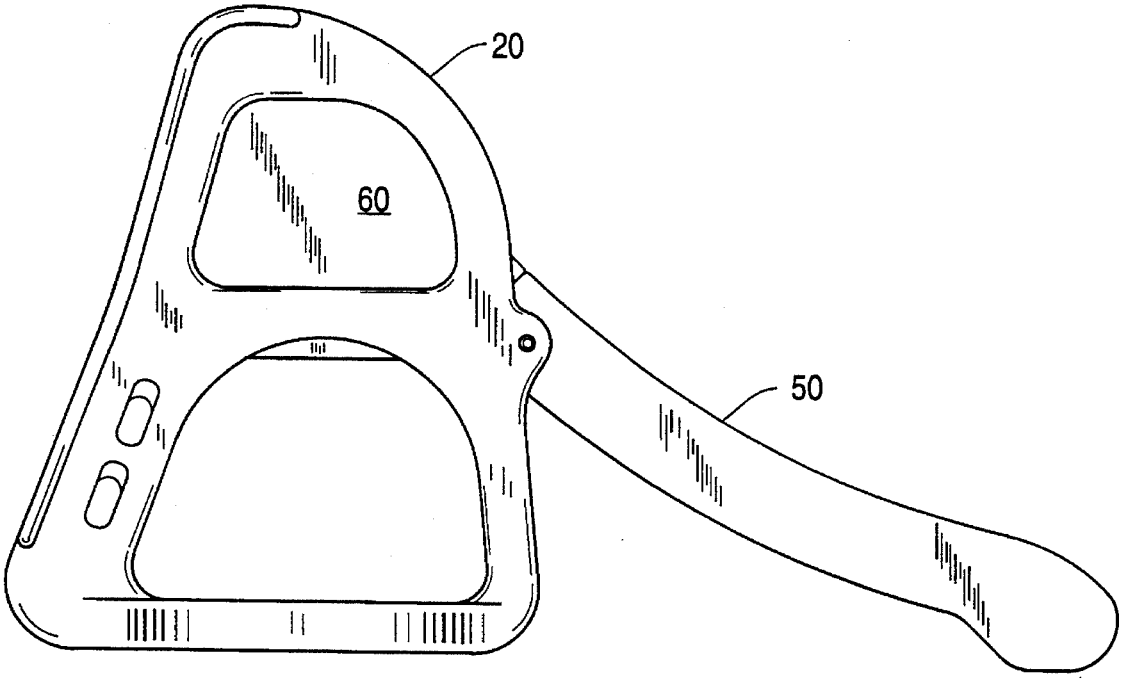
FIGS. 1C, 1D, 1E and 1F are side, rear, top and front views, respectively, of the slide apparatus in the high slide height configuration.
Figure 1D:
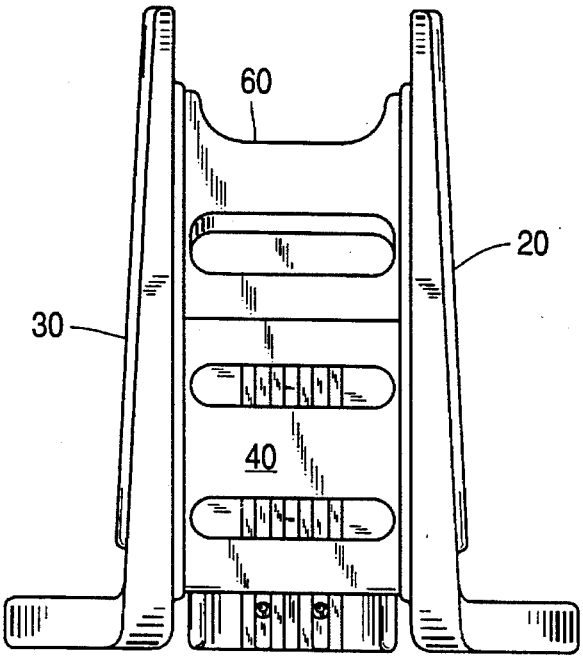
Figure 1E:
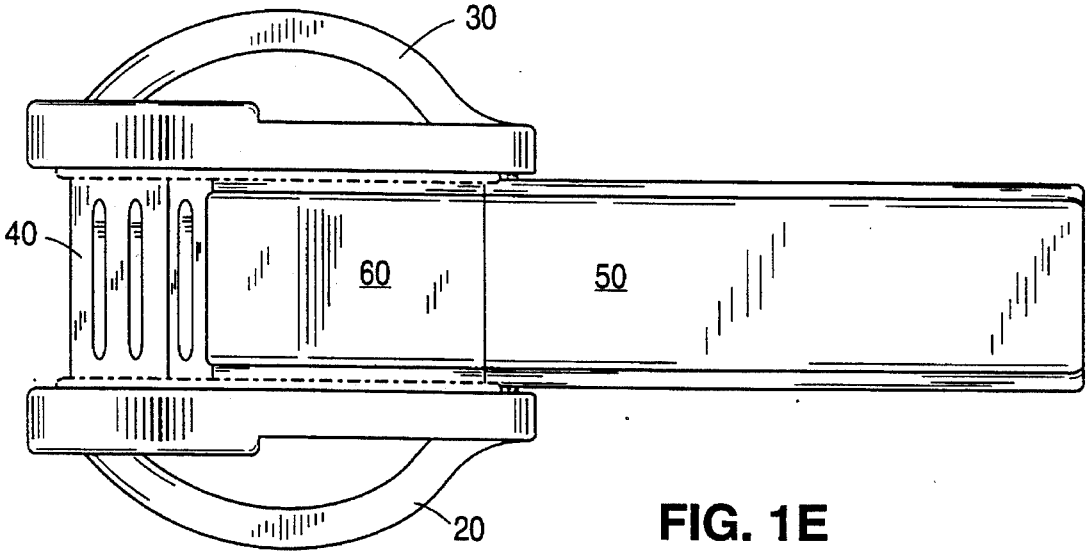
Figure 1F:
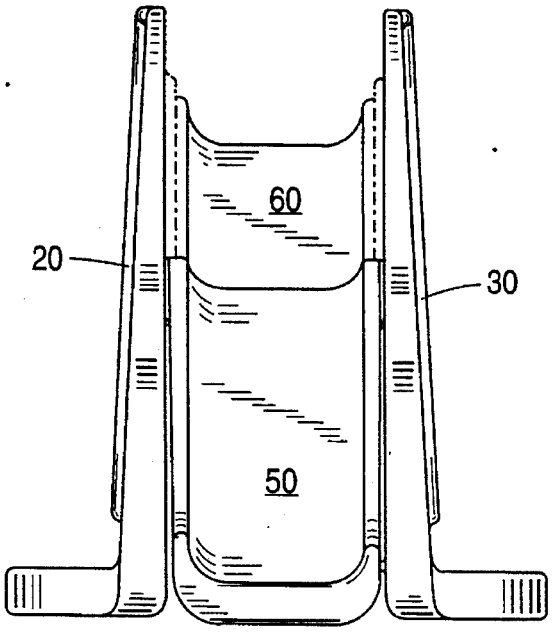
Figure 1G:
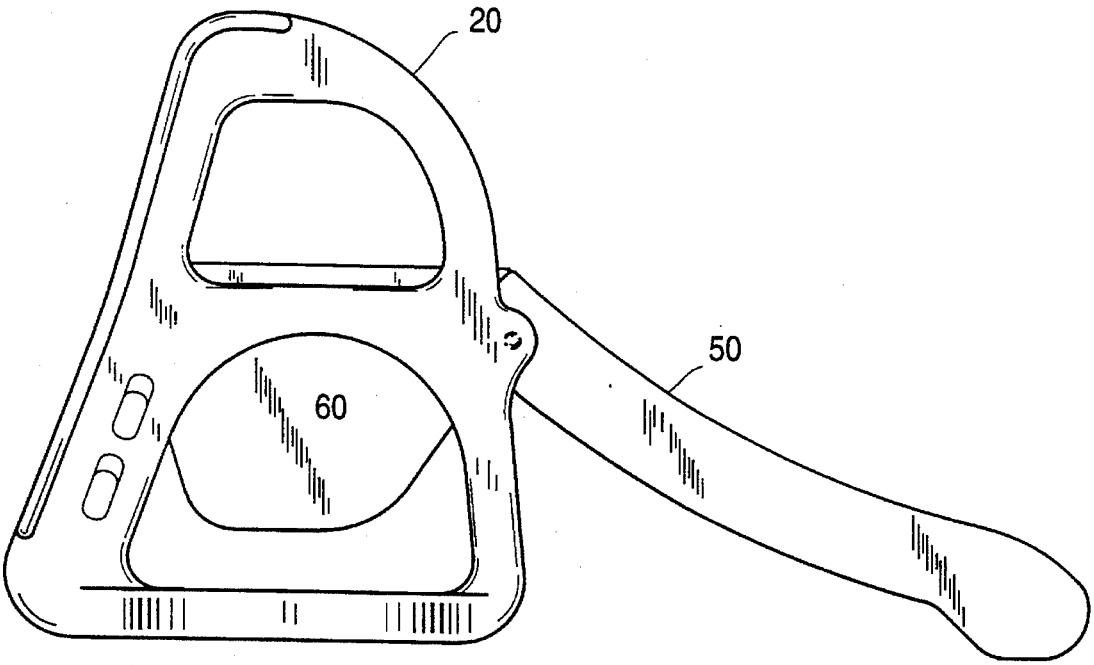
FIGS. 1G, 1H, 1I and 1J are side, rear, top and front views, respectively, of the slide apparatus in the low slide height configuration.
Figure 1H:
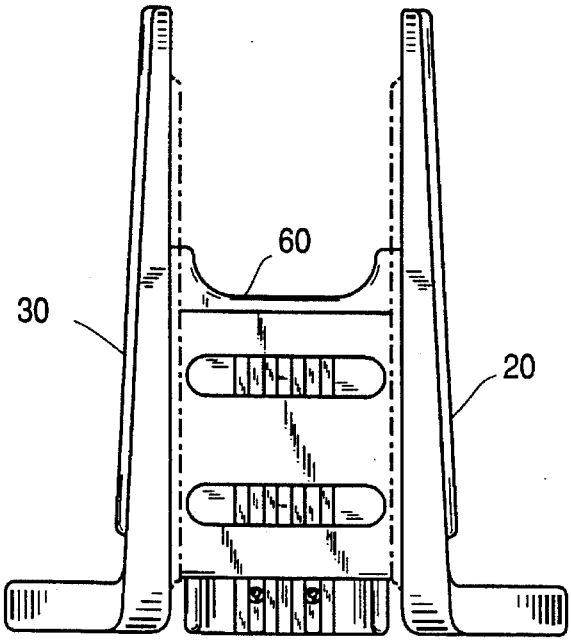
Figure 1I:
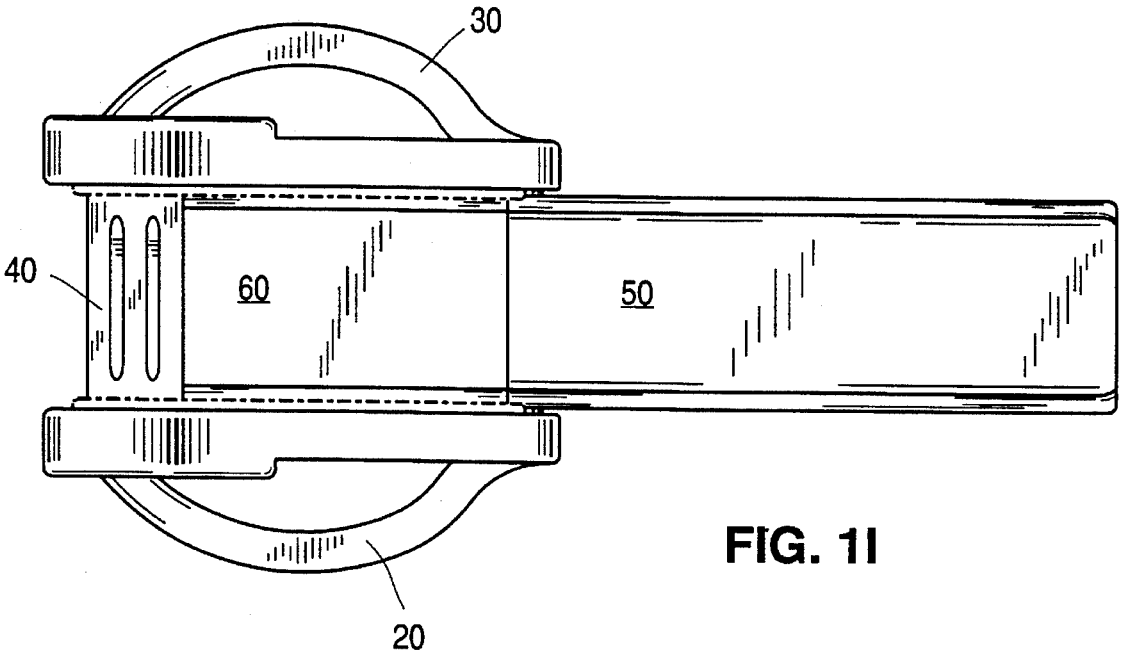
Figure 1J:
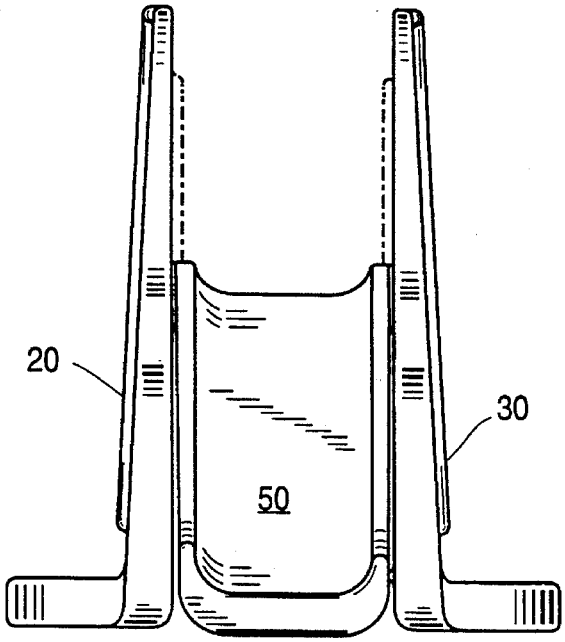
Figure 2A:
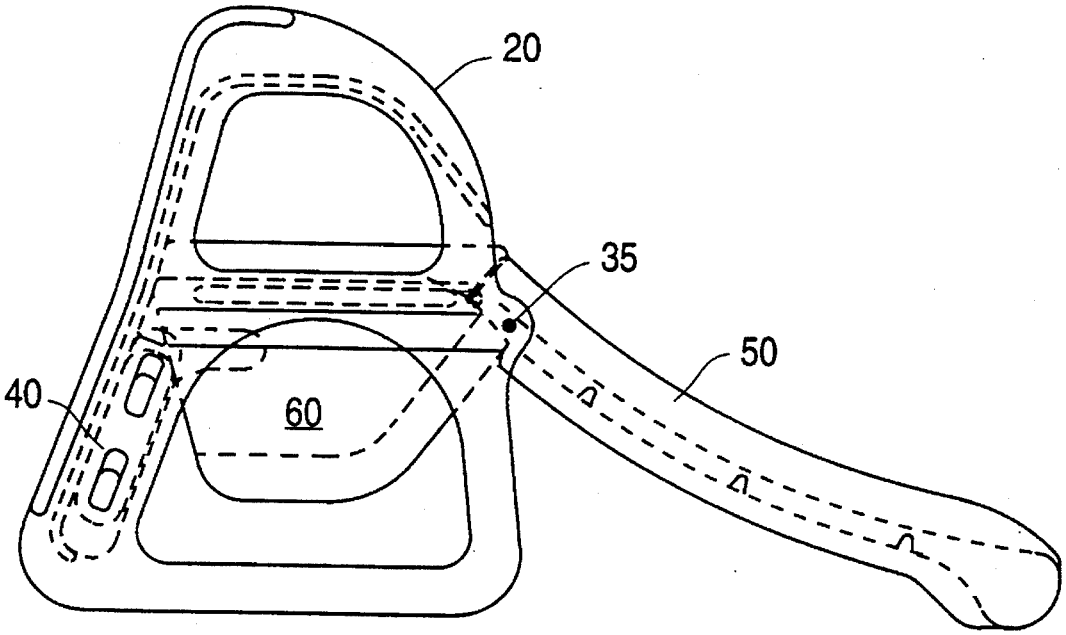
FIG. 2A is a left side layout view of the slide apparatus in the low slide height configuration.
Figure 2B:
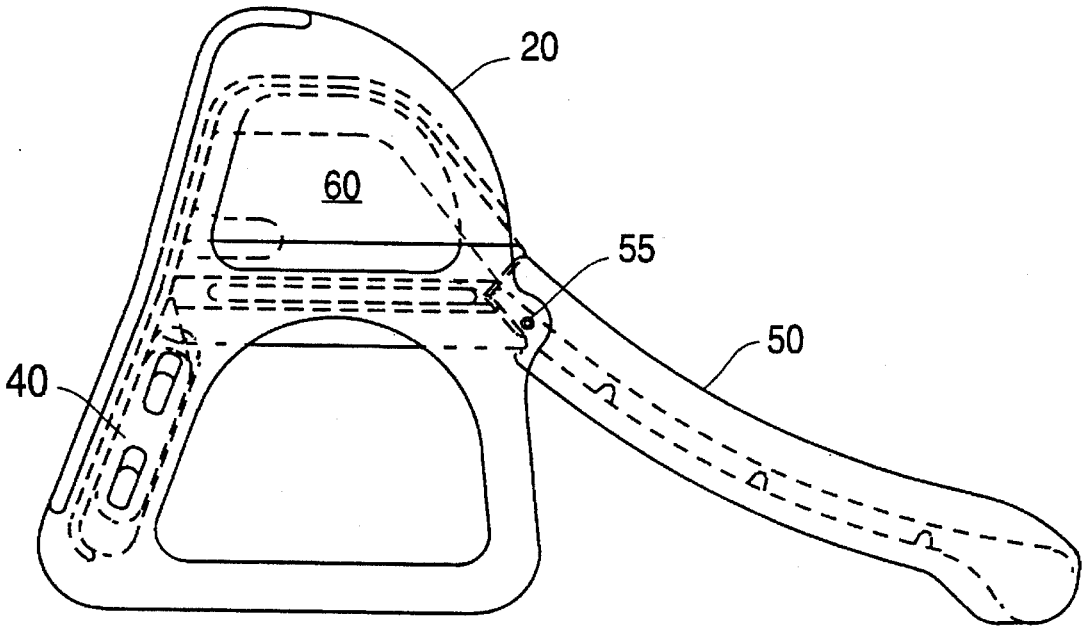
FIG. 2B is a left side layout view of the slide apparatus in the high slide height configuration.
Figure 3A:
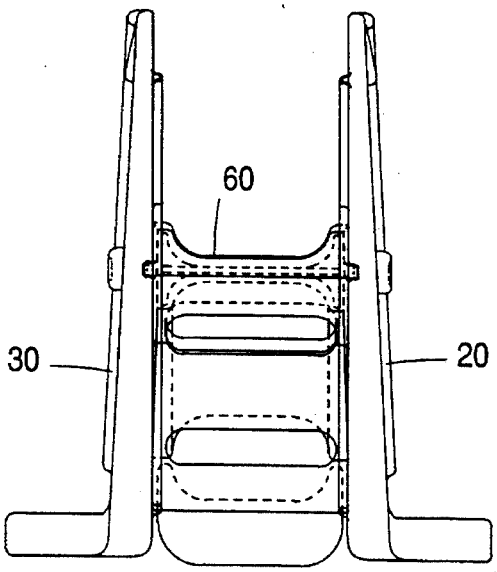
FIG. 3A is a rear layout view of the slide apparatus in the low slide height configuration.
Figure 3B:
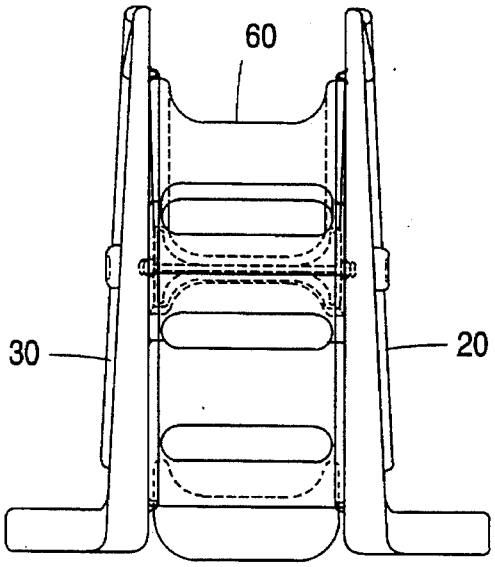
FIG. 3B is a rear layout view of the slide apparatus in the high slide height configuration.
Figure 4:
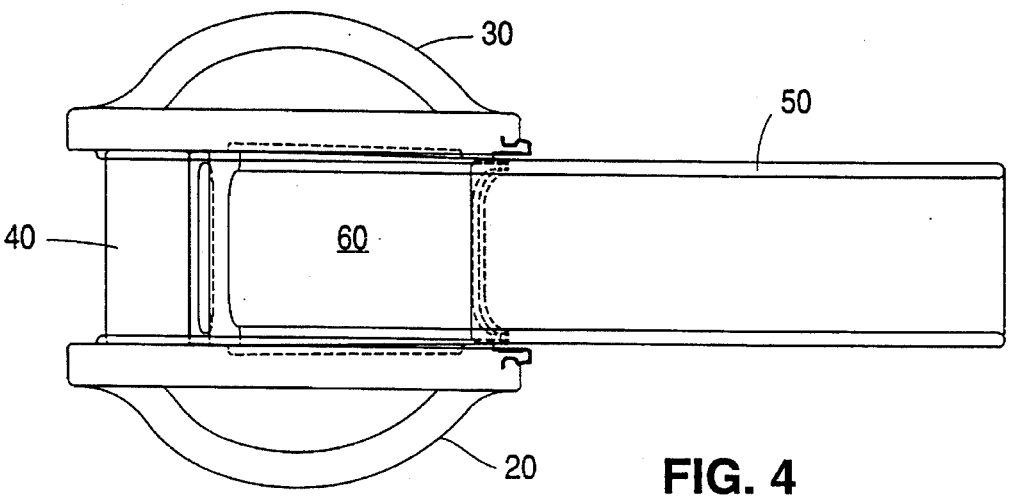
FIG. 4 is a top layout view of the slide apparatus in the high slide height configuration.
Figure 5A:
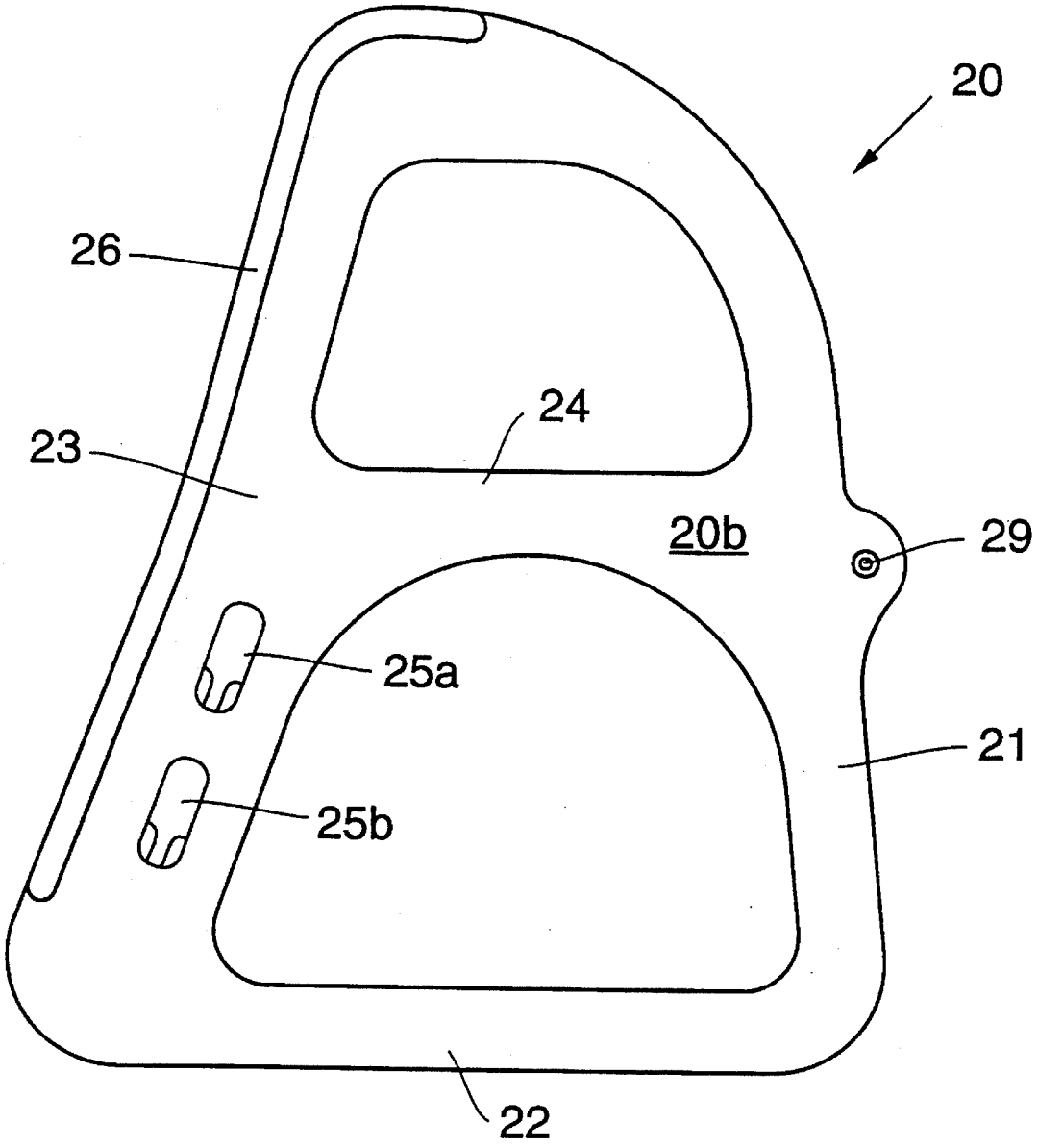
FIGS. 5A, 5B, 5C, and 5D are front, rear, left side and top views, respectively of a first side support member.
Figure 5B:
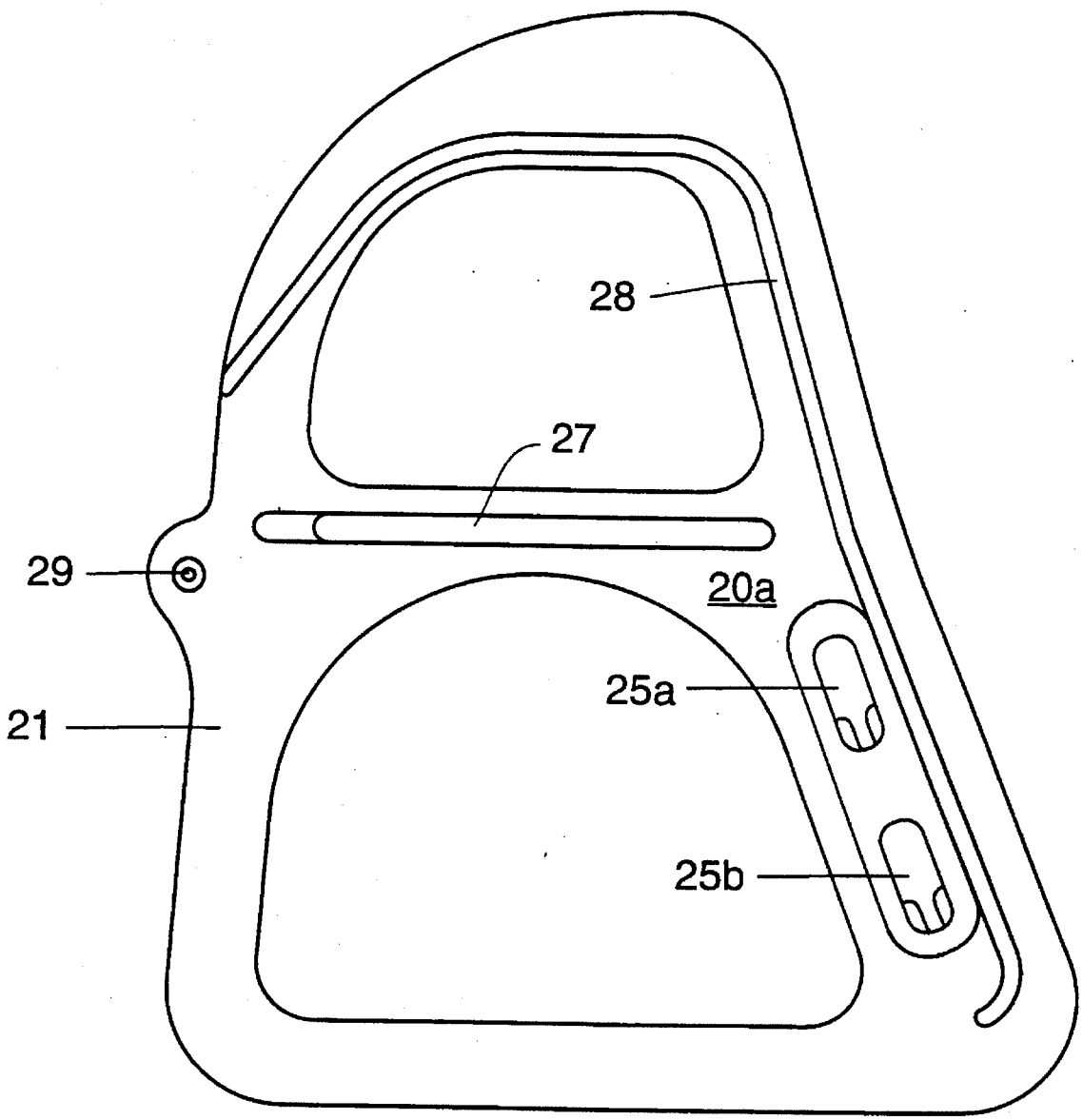
Figure 5C:
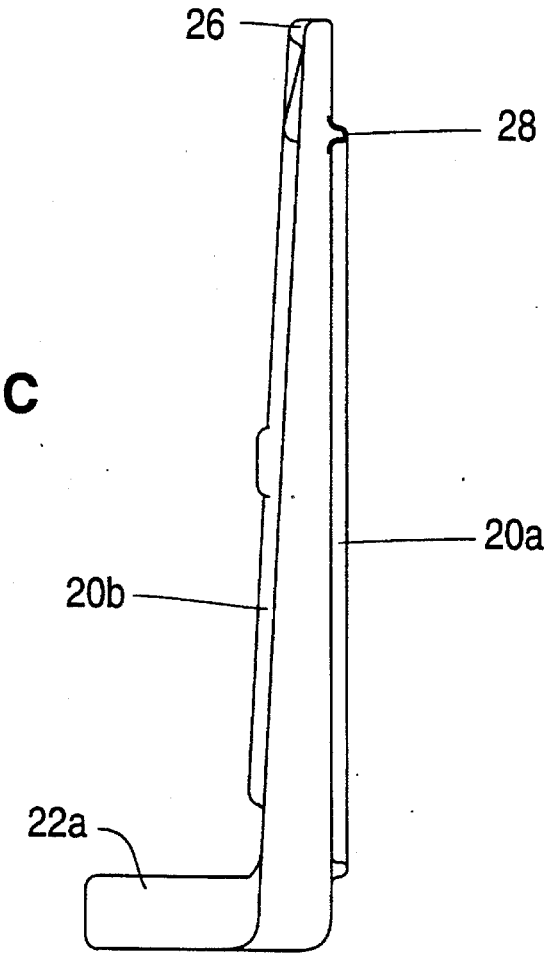
Figure 5D:
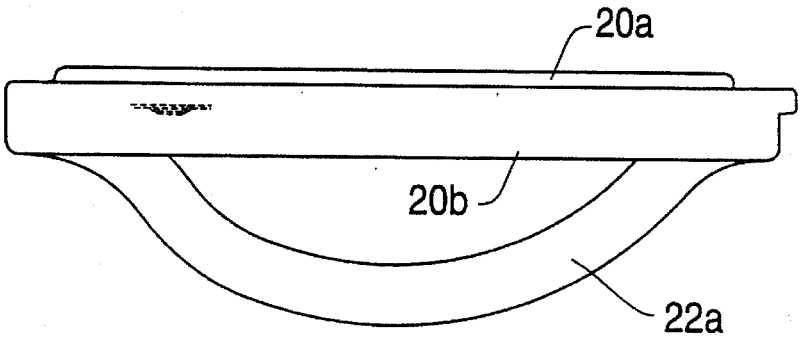

Reference will now be made in detail to presently preferred embodiments of the invention, examples of which are illustrated in the accompanying drawings. As illustrated in FIGS. 1A through 1J, the slide apparatus 10 generally includes a supporting frame comprising a first side support member 20 and a second side support member 30 which is reversed but symmetrical with the first side member 20. A ladder member 40 interconnects with and spans between the first and second side support members 20 and 30 at the rear of the slide apparatus. The slide member 50 provides an angled slide surface and is connected to the first and second side support members 20 and 30 by fasteners such as screws that pass through holes in mounting points at the front of the first and second side support members and engage jacknuts set in mounting points at the top and of the slide, and thus the slide 50 also spans between and connects the first and second side support members 20 and 30 together. A block 60 is reversible between two orientations to adjust the overall slide height. In a first orientation, depicted in FIGS. 1G through 1J, the block 60 provides a substantially horizontal first platform surface leading to the top end of the slide 50. In a second orientation, depicted in FIGS. 1C through 1F, the block 60 provides an additional step and a higher substantially horizontal second platform surface, as well as a slide extending portion that is contiguous with the top end of the slide 50 and that extends the overall length of the sliding surface.

Each of the components of the invention will now be described in greater detail. Referring to FIGS. 5A through 5D, the first side support member 20 has an inner side surface 20a and an outer side surface 20*b* and includes a front portion 21, a bottom portion 22, a rear portion 23, and a cross-bar portion 24. A foot portion 22*a* of the bottom portion 22 helps stabilize the side support member 20. The rear portion 23 includes two female connector slots 25*a* and 25*b*, which receive and hold male connector keys 42*a* and 42*b* on the ladder member 40. The rear portion 23 may also include a handrail flange 26. A ridge 28 may be provided on the inner surface 20*a*. This ridge 28 helps stiffen the panel 20 and contacts the periphery of the block 60 when the block 60 is in the high slide height orientation to help stably hold the block 60 in that orientation. The first side portion also includes a reinforced hole 29 for accepting a fastener to attach the top end of the slide 50 thereto. A groove 27 is provided to receive and hold a rib 63 on the block 60 when the block 60 is in the first orientation, and to receive and hold a rib 62 on the block 60 when the block is in the second orientation.

Figure 6A:
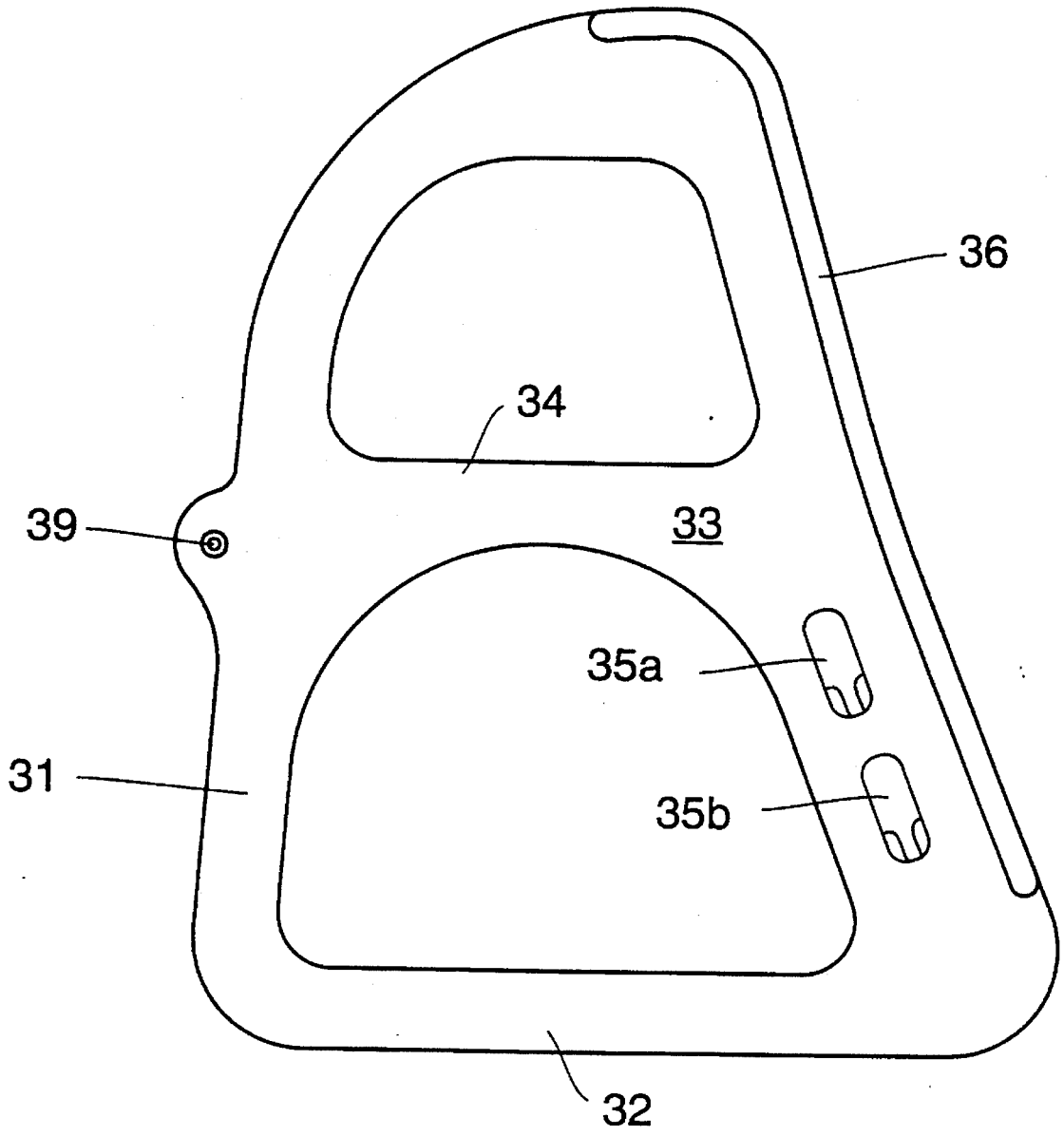
FIGS. 6A, 6B, 6C and 6D are front, rear, left side and top views, respectively of a second side support member.
Figure 6B:
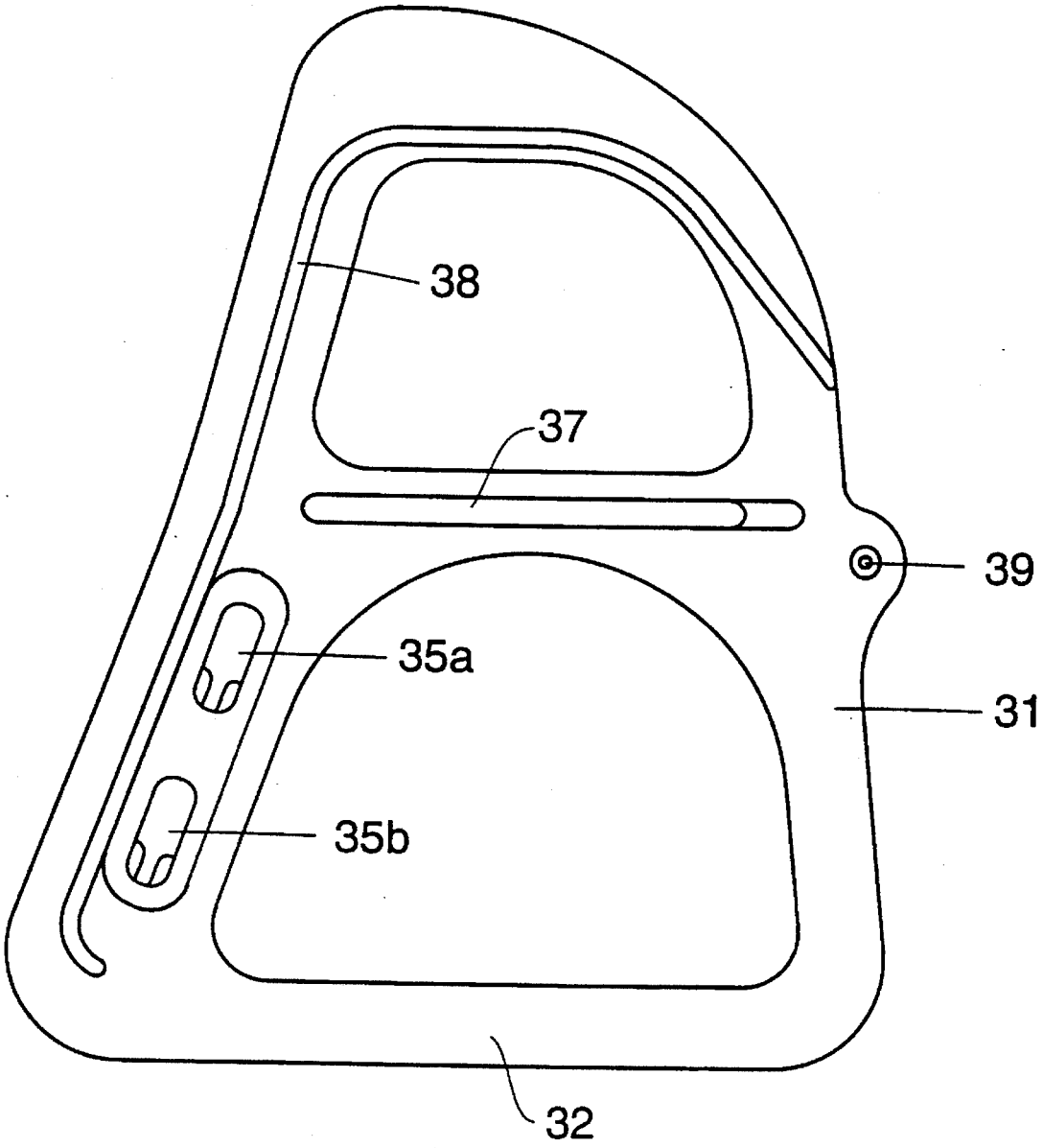
Figure 6C:
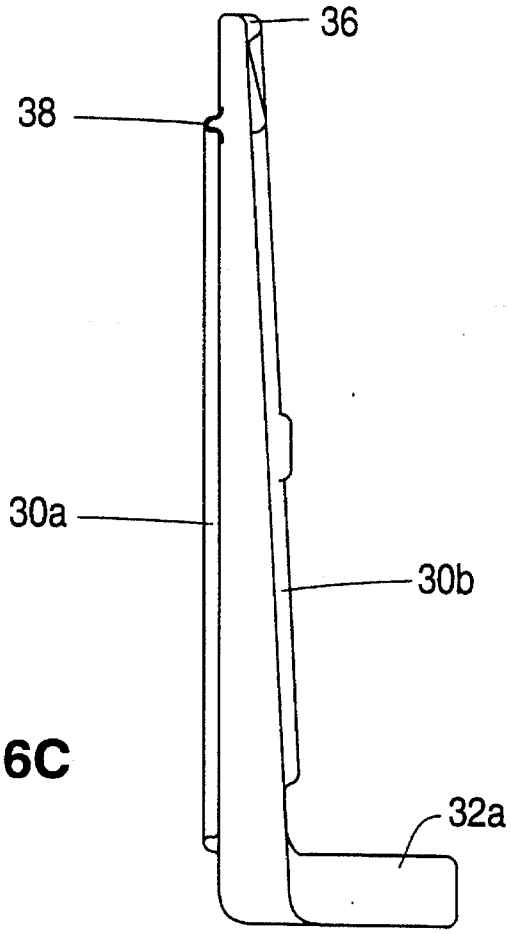
Figure 6D:
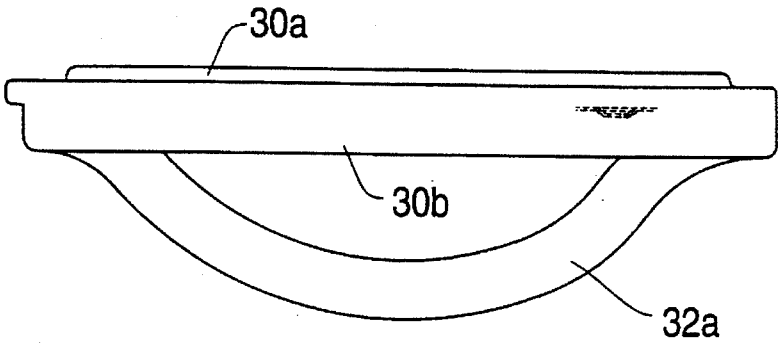

Referring now to FIGS. 6A through 6 D, the second side support member 30 is similar to the first side member 20 but is symmetrically reversed. Accordingly, the second side member 30 has an inner side surface 30 and an outer side surface 30 and includes a front portion 31, a bottom portion 32, a rear portion 33, and a cross-bar portion 34. A foot portion 32a on the bottom portion 22 helps stabilize the side support member 20. The rear portion 33 includes two female connector slots 35*a* and 35*b*, which receive and hold male connector keys 43*a* and 43*b* on the ladder member 40. The rear portion 33 may also include a handrail flange 36. A ridge 38 may also be provided on the inner surface 20*a*. This ridge 38 helps stiffen the panel 30 and contacts the periphery of the block 60 when the block 60 is in the high slide height orientation to help stably hold the block 60 in that orientation. The side portion also includes a hole 39 for accepting a fastener to attach the top end of the slide 50 thereto. A groove 37 is provided to receive and hold the rib 62 when the block is in the first orientation, and to receive and hold the fib 63 when the block is in the second orientation.

Figure 7A:
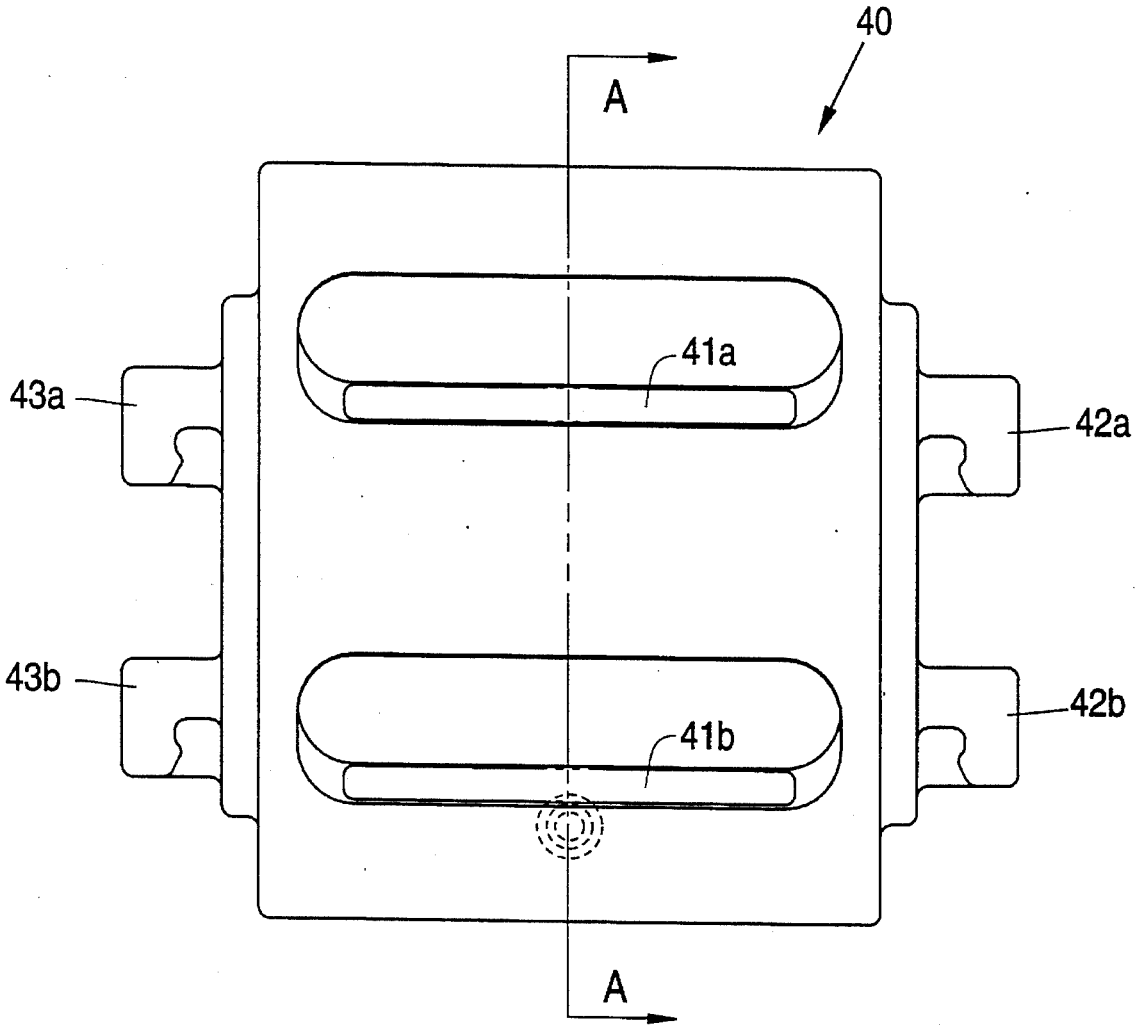
FIGS. 7A, 7B, 7C, and 7D are front, rear, left side, and bottom views of a ladder member.
Figure 7B:
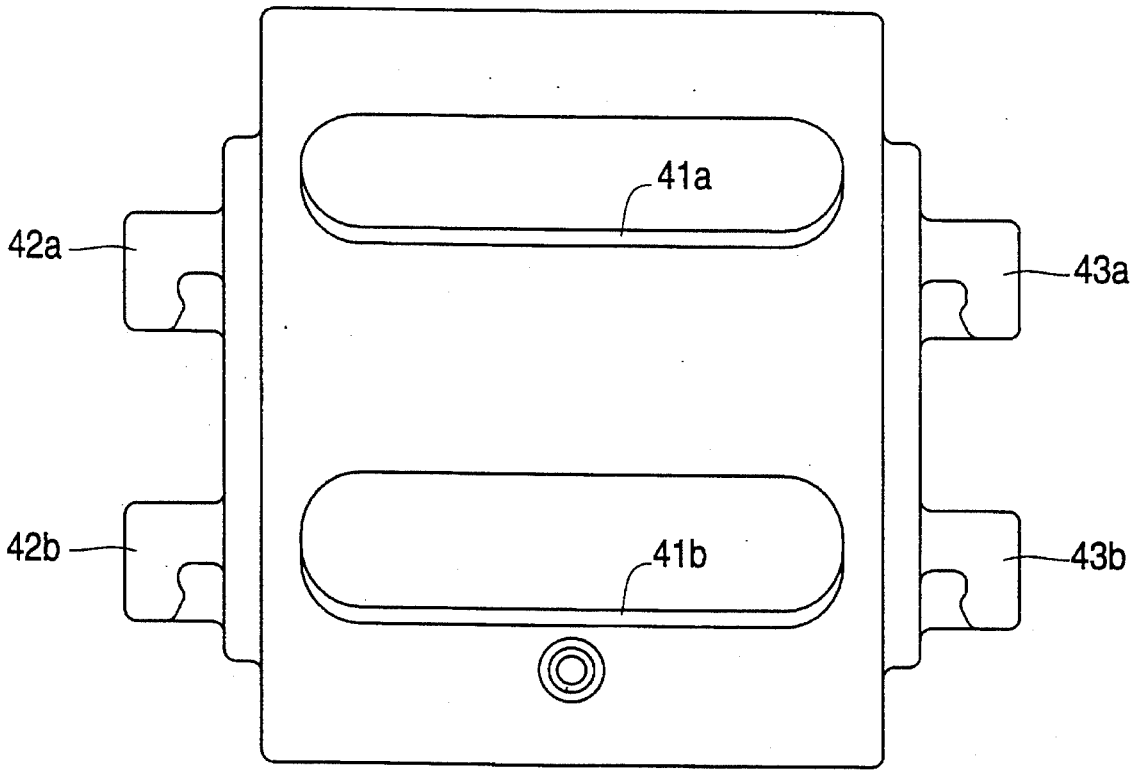
Figure 7C:
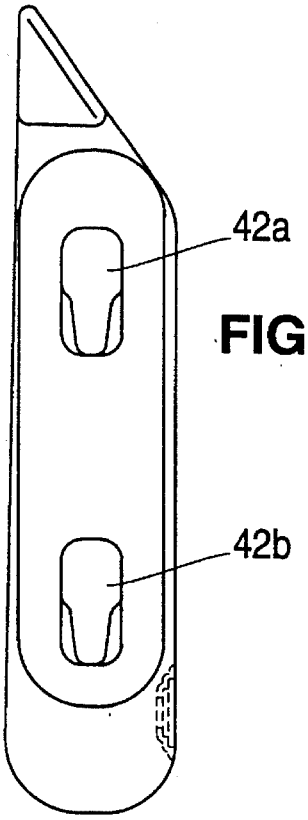
Figure 7E:
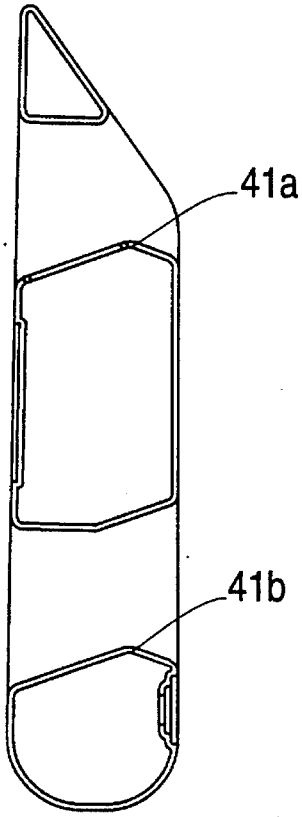
FIG. 7E is a cross-sectional view taken along line A—A in FIG. 7A.
Figure 7D:
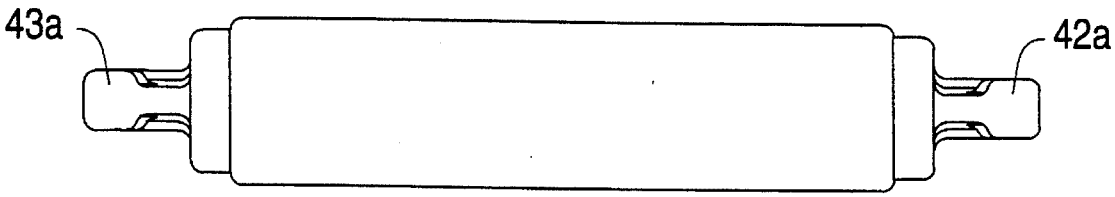

As shown in FIGS. 7A through 78E, the ladder member 40 includes two step rungs 41*a* and 41*b*. The ladder member 40 also includes male connector keys 42*a*, 42*b*, 43*a*, and 43*b* which fit into female connector slots 25*a*, 25*b*, 35*a*, and 35*b*, respectively. The design of these connectors (keys 42*a*, 42*b*, 43*a*, 43*b* and slots 25*a*, 25*b*, 35*a* and 35*b*) is discussed in more detail below.

As shown in FIGS. 8A through 8F, the reversible block 60 is shaped so that fibs 62 and 63 at the sides 61*a* and 61*b* of the block 60 can rest in grooves 27 and 37 provided on the first and second side members 20 and 30. In the first orientation shown in FIG. 8C, the rib 63 fits in the groove 27 and the fib 62 fits in the groove 37. The block 60 has a first surface 64 that is shaped in such a way that in the first orientation it provides a low and substantially horizontal platform surface 64 leading to the top of the slide 50.

Figure 8A:
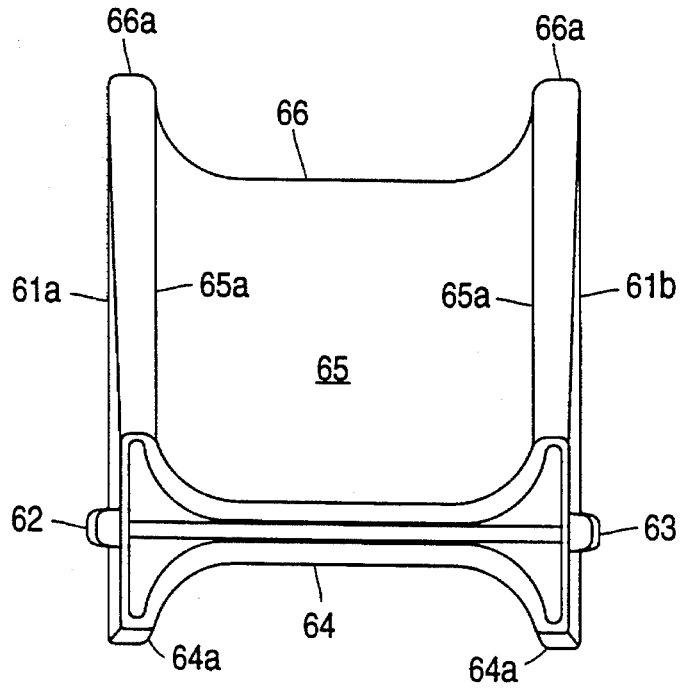
FIGS. 8A is a front view of a slide block in the high slide height orientation.
Figure 8B:
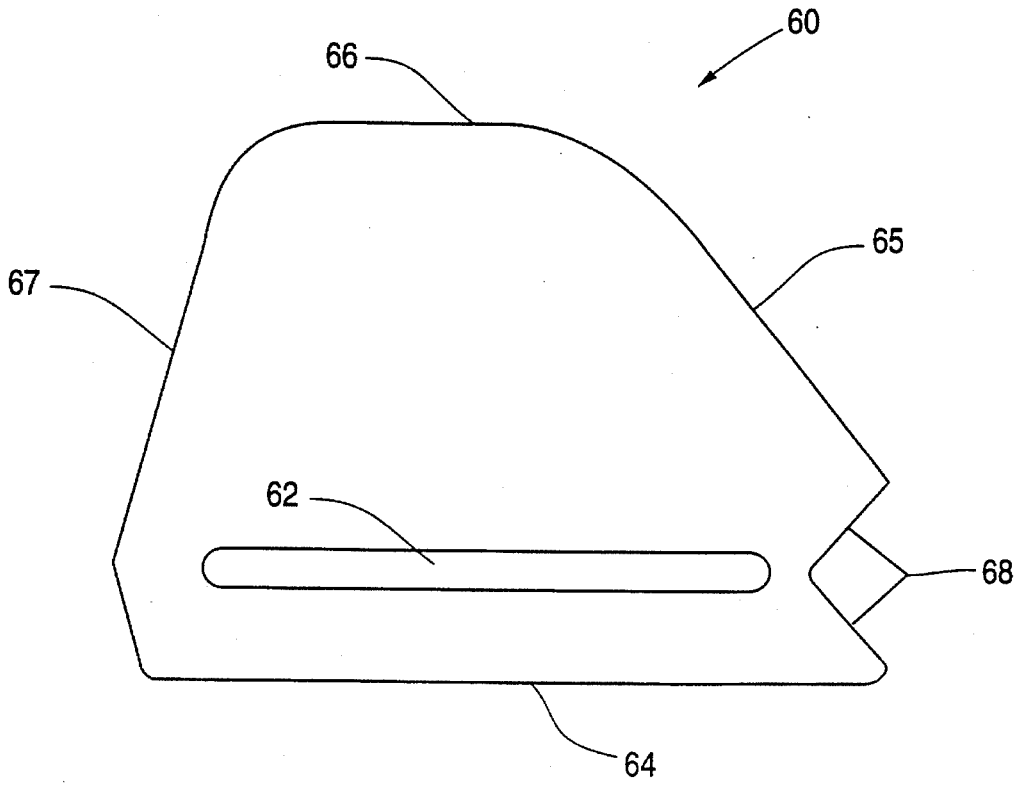
FIGS. 8B and 8C are side views of the slide block in the high and low slide height orientations, respectively.
Figure 8C:
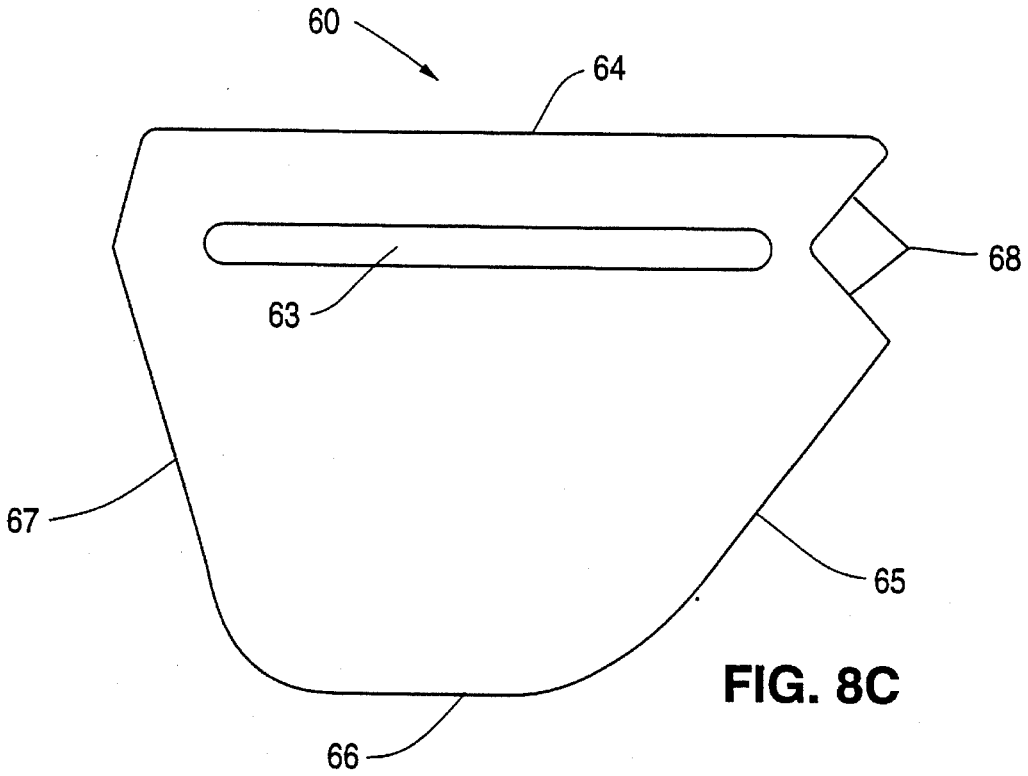
Figure 8D:
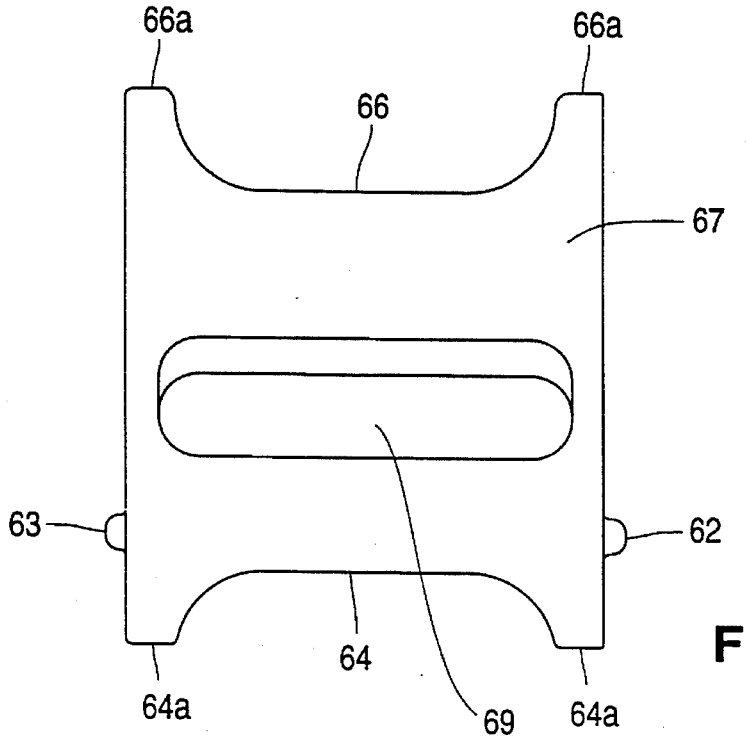
FIG. 8D is a rear view.
Figure 8E:
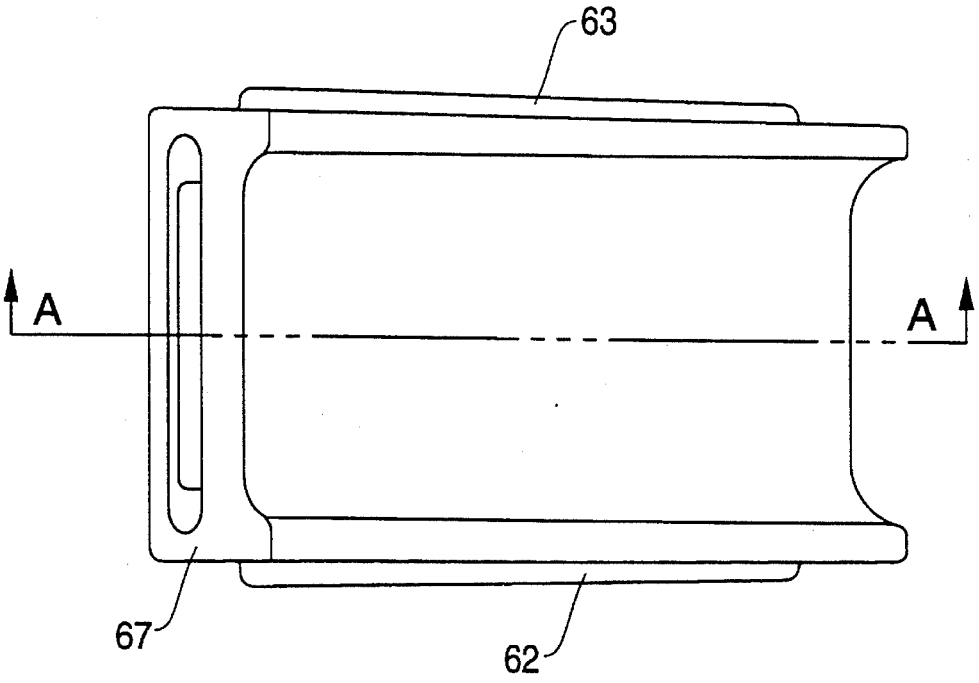
FIG. 8E is a top view respectively, of the slide block in the high slide height orientation.
Figure 8F:
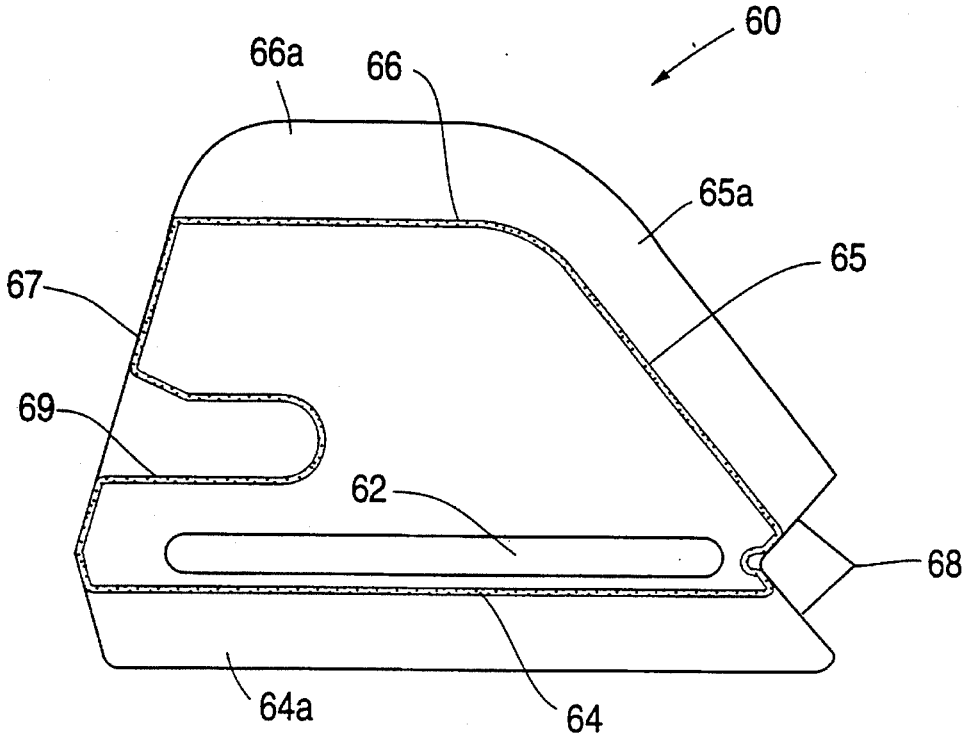
FIG. 8F is a cross-sectional view taken along line A—A in FIG. 8E.
Figure 9A:
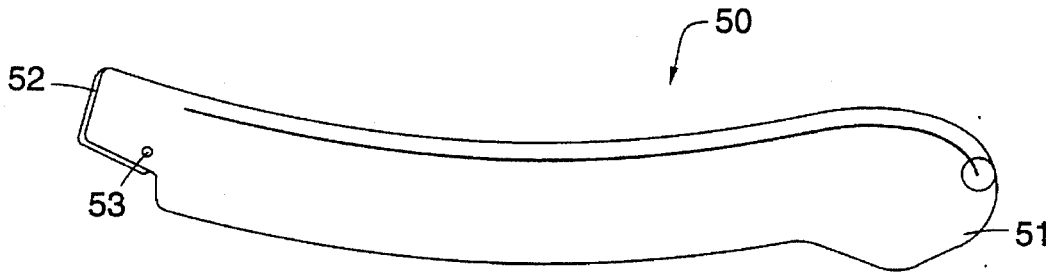
FIGS. 9A, 9B and 9C are side, top and bottom views, respectively of a slide member.
Figure 9B:
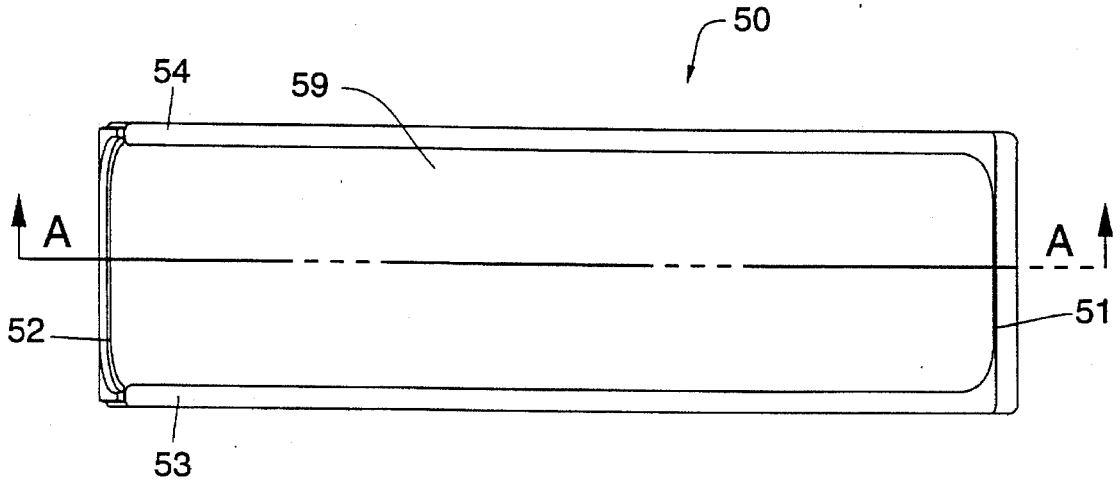
Figure 9C:
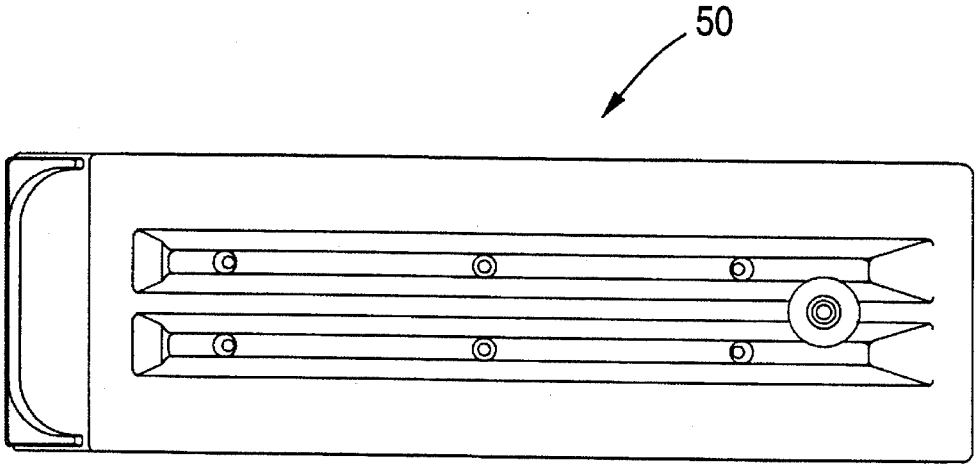
Figure 9D:
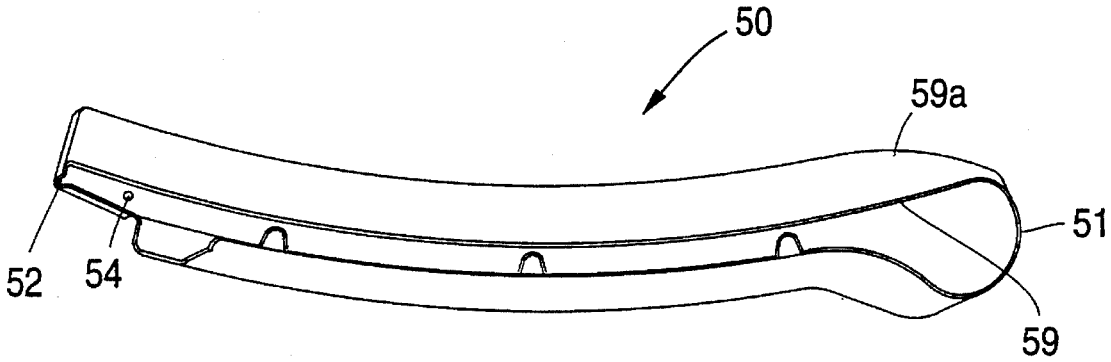
FIG. 9D is cross-sectional view taken along line A—A in FIG. 9B.

The block 60 is also reversible by flipping it over 180° into a second orientation shown in FIG. 8B, and the block 60 has a second surface 65 that forms a sloped slide portion 65 in the second orientation that becomes contiguous with the slide surface at top of the slide 50 to extend the length of the overall sloping slide to a greater combined length reaching a higher height. In the second orientation, the rib 62 in fits in the groove 27 and the rib 63 fits in the groove 37. The block 60 also has a third surface 66 that forms a substantially horizontal high platform surface 66 which in the second orientation is located at a higher height than the height of the low horizontal platform surface 64 in the first orientation. Each of the surfaces 64, 65 and 66 have upwardly curving sides 64*a*, 65*a* and 66*a*.

The back side 67 of the block 60 is provided with a step indentation 69, which when the block 60 is in the second orientation, is located just above the ladder 40 and provides a step for stepping up to the high platform surface 66 on the top of the block when the block is in the second orientation.

When the block 60 is in the first orientation, the back side 67 of the block 60 and the step indentation 69 are both positioned out of the way generally behind the ladder 40 and the step indentation 69 is not used.

The block 60 also has a v-shaped surface 68 corresponding in shape to the surface of the surface of the top end 52 of the slide 50. The surface 68 permits the block 60 to abut the top end 52 of the slide 50 when the block 60 is in either of the first or second orientations.

Referring now to FIGS. 9A through 9D, the slide member 50 has a bottom end 51 that rests on the ground and a top end 52 that attaches to the first and second side support members 20 and 30. Fastener receiving jacknuts 53 and 54 are provided on the sides of the slide 50 near the top end 52 so that the slide 50 can be attached by the fasteners such as screws inserted through the holes 29 and 39 in the first side support member 20 and the second side support member 30, respectively. The slide member 50 provides an angled trough-type sliding surface 59 with upwardly curving sides 59a when attached to the side support members 20 and 30.

The slide apparatus is assembled as follows. First, the ladder 40 is attached by inserting keys 42*a*, 42*b*, 43*a* and 43*b* into slots 25*a*, 25*b*, 26*a* and 26*b* respectively. Pushing down on the ladder 40 seats the keys firmly in the slots as shown in FIG. 11B. Thus, the side support panels 20 and 30 are held together at their rear portions 23 and 33 by the ladder 40, and the slide block 60 is securely held between the side support panels 20 and 30. This attachment provides some free play caused by flexing at the attachment points of the ladder 40 to the rear portions 23 and 33 so that the first side support panel 20 and the second side support panel 30 can be spread apart slightly relative to each other at the front portions 21 and 31, permitting the block 60 to be inserted in between of the side segment panels 20 and 30 in the desired orientation. (In the first, low slide height orientation, the rib 63 fits in groove 27 and the rib 62 fits in groove 37; in the second, high slide height orientation, the rib 62 fits in the groove 27 and the rib 63 fits in groove 37.) After the slide block 60 is inserted, the slide 50 is attached to both side support panels 20 and 30 by tightening the screws 55 or other appropriate fasteners inserted into jacknuts 53 and 54. To change the orientation of the block 60, the screws 55 are removed to allow the side support panels 20 and 30 to be spread apart slightly, which permits removal of the block 60. Then the block 60 is re-positioned in the other orientation and the screws 55 are reconnected as described above.

Figure 10A:
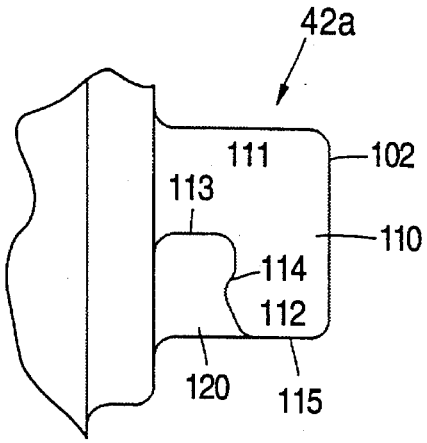
FIGS. 10A and 10B are side and bottom views, respectively, of a male connector key.
Figure 10B:
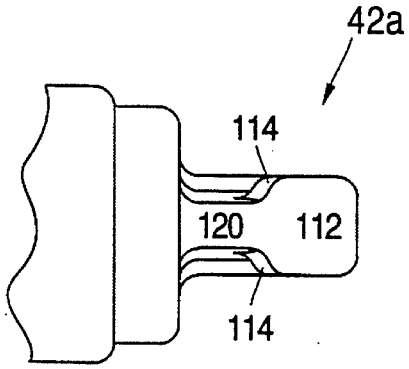
Figure 10C:
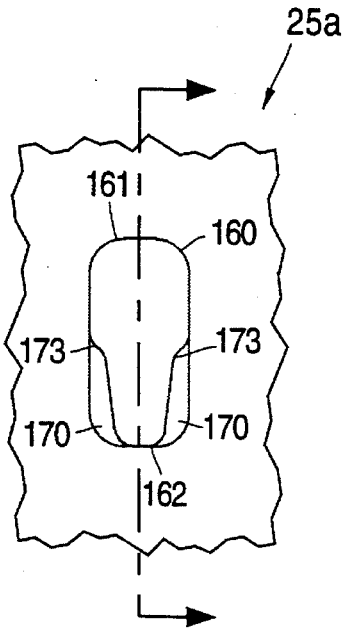
FIG. 10C is a front view of a female connector slot.
Figure 10D:
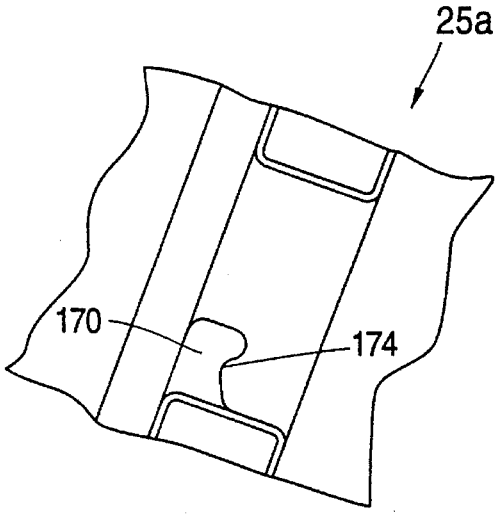
FIG. 10D is a cross sectional view, taken along line A—A in FIG. 10C, of a female connector slot.

An example of the the male and female connectors used in the invention to connect ladder member 40 to the side support members 20 and 30 will now be described. Although the connectors described below are preferred, other connectors may be used. The male connector key 42*a* illustrated in FIGS. 10A and 10B and the female connector slot 25*a* illustrated in FIGS. 10C and 10D described below are representative of the general configuration of all of the male and female connectors (42*a*, 42*b*, 43*a*, 43*b*, 25*a*, 25*b*, 35*a* and 35*b*).

The male connector 42*a* projects from the ladder 40 and includes a key 102 having a body 110 and a rib 120, with the thickness of the body 110 being greater than the thickness of the rib 120. The body 110 has an upper portion that is of the same thickness as, and continuous with, a lower portion 112. Surfaces 113 and 114 adjoin the rib 120 and the body 110. The inclusion of the rib 120 is advantageous in the manufacturing context when the ladder 40 is hollow and roto-molded (or blow molded) from plastic, since the rib 120 facilitates the flow of plastic to the lower portion 112 during the molding process.

The female connector slot 25*a* includes an aperture 160 extending through the other panel to be connected and having a width at least as great as the thickness of the key 110. A pair of shoulders 170 are located on both sides of a lower portion of the aperture 160 and are shaped to fit against the rib 120. The height between the top surface 173 of the shoulders 170 and the top end 161 of the aperture 160 is at least as large as the overall height of the key 101 to permit sufficient clearance for the key 110 to be inserted into the aperture 160 above the shoulders 170, so that the lower portion 112 will clear the shoulders 170.

Generally, to perform the insertion of the key 102 into the aperture 160, the ladder member with the key 102 is raised relative to the panel with the aperture 160. Once the key 101 is inserted, the ladder 40 with the key 101 is lowered so that the bottom 115 of the key 101 rests on the bottom 162 of the aperture 160. The surfaces 113 of the key 101 then also rests on the top surfaces 173 of the ridges 170. The surface 114 may have a curved shape and the surface 174 may have a corresponding curved shape to help resist the key 101 disengaging from the aperture 160 by resisting upward movement of the key 101 relative to the aperture 160.

In the preferred embodiment, both the first and second side support members 20 and 30, the ladder 40, the slide 50, and the block 60 are hollow and roto molded from plastic. However, other suitable materials and/or any other suitable molding or other manufacturing methods may be used to manufacture any or all of the components. Also, the panels may of course be molded or formed as solid parts from any suitable material, including but not limited to plastic, wood or metal.

What is claimed is:

1. A slide apparatus having an extendible slide surface length, comprising:

a slide member having a lower end, an upper end, and a slide surface extending from said upper end to said lower end;

a block member having a first surface and a second surface angled relative to said first surface; and a frame supporting said slide member so that said slide surface is angled relative to horizontal, said frame also supporting said block member so that said block member is changeable between a first orientation at which said first surface is substantially horizontal and meets said slide surface at said slide upper end, and a second orientation at which said second surface is angled relative to horizontal and meets said slide surface substantially contiguously at said upper end, wherein in the first orientation said first surface forms a platform leading to said slide surface at said slide upper end, and in the second orientation said second surface forms an extension slide surface leading to said slide surface at said slide upper end and extending the overall slide surface length.

2. A slide apparatus according to claim 1, wherein said block member further has a third surface adjacent to and angled relative to said second surface, said third surface being parallel to said first surface, and wherein in the second orientation said third surface is substantially horizontal and forms a platform leading to said second surface.

3. A slide apparatus according to claim 1, further comprising a ladder mounted to said frame and leading up to said block member.

4. A slide apparatus according to claim 3, wherein said block member has a fourth surface, said fourth surface including a second ladder portion leading up to said third surface when said block is in the second orientation.

5. A slide apparatus according to claim 3, wherein said frame comprises two side support members and said ladder and said slide each span between and are connected to said side support members.

6. A slide apparatus according to claim 5, wherein each one of said side support members has a groove defined thereon, and wherein said block has ribs extending therefrom that each engage one said groove.

* * * * *